US005682819A

United States Patent [19]

Beaty

[11] Patent Number: 5,682,819

[45] Date of Patent: Nov. 4, 1997

[54] METHOD FOR CANCELING LOTTERY TICKETS

[76] Inventor: Eugene A. Beaty, 1568 Lakeland Ave., Akron, Ohio 44320

[21] Appl. No.: 496,684

[22] Filed: Jun. 29, 1995

[51] Int. Cl.[6] ..... B41F 1/28

[52] U.S. Cl. ..... 101/483; 235/375; 235/475; 273/148 R

[58] Field of Search ..... 101/484, 483; 235/375, 380; 283/903, 72; 400/74, 103, 104, 105, 106, 107; 364/412; 273/148 R

[56] References Cited

U.S. PATENT DOCUMENTS

| | | | |
|---|---|---|---|
| 3,589,291 | 6/1971 | Koszul | 101/490 |
| 4,204,637 | 5/1980 | Gray | 235/431 |
| 4,299,637 | 11/1981 | Oberdeck et al. | 156/277 |
| 4,695,171 | 9/1987 | Sapitowicz | 101/66 |
| 4,882,473 | 11/1989 | Bergeron et al. | 235/380 |
| 4,896,466 | 1/1990 | Hartman et al. | 101/69 |
| 4,902,880 | 2/1990 | Garcynski et al. | 235/375 |
| 5,091,634 | 2/1992 | Finch et al. | 235/375 |
| 5,128,520 | 7/1992 | Rando et al. | 235/461 |
| 5,173,596 | 12/1992 | Kapinos et al. | 235/475 |
| 5,193,854 | 3/1993 | Borowski, Jr. et al. | 283/87 |
| 5,239,165 | 8/1993 | Novak | 235/375 |
| 5,249,801 | 10/1993 | Jarvis | 273/148 R |
| 5,286,061 | 2/1994 | Behm. | 283/95 |
| 5,311,017 | 5/1994 | Filo | 250/316.1 |
| 5,317,135 | 5/1994 | Finocchio | 235/375 |
| 5,403,039 | 4/1995 | Borowski, Jr. et al. | 283/87 |
| 5,471,039 | 11/1995 | Irwin, Jr. et al. | 235/375 |

*Primary Examiner*—Eugene H. Eickholt

[57] ABSTRACT

The invention is a method of issuing or altering lottery tickets to make them less vulnerable to fraud. The method involves marking the ticket, either manually or mechanically, as void before it may be canceled by the machine. Ticket reprints would be eliminated, and the terminal would have to read a portion of the barcode and the void mark to cancel a ticket. A complete serial number could be typed in if the barcode is not able to be read by the terminal. The requirement that the actual ticket being canceled be read by the scanner in the terminal would eliminate the fraud associated with the cancellation of lottery tickets.

4 Claims, 3 Drawing Sheets

METHOD FOR CANCELING LOTTERY TICKETS

BACKGROUND OF THE INVENTION

1. Field of Invention

This invention pertains generally to the art of lottery tickets, and more specifically to methods for canceling lottery tickets.

2. Description of the Related Art

Many states now offer state lotteries, with a variety of different games that offer payouts, some very large, depending upon the odds of correctly picking numbers that are drawn at random. For example, the state of Ohio offers players a Pick 3 where the player picks 3 numbers between 0 and 9, a Pick 4 where the player picks 4 numbers between 0 and 9, a Buckeye 5 where the player picks 5 numbers between 1 and 37, and the Super Lotto where the player picks 6 numbers between 1 and 47. The numbers are selected using a bet slip that is scanned by a lottery terminal or by manually entering the numbers into the lottery terminal. Given the nature of the equipment, the vast number of players that play these games, and large number of numbers that are to be selected, mistakes happen that must be canceled. These mistakes often occur when an operator enters a wrong number or the terminal scanning device picks up stray marks on a bet slip.

In the past, cancellation of tickets has been accomplished by either scanning a ticket for a barcode or manually entering the serial number of the ticket to be canceled. The opportunity for fraud has been great due to the ability of agents to reprint tickets, then cancel the ticket after the customer has purchased the ticket and left the store. In addition, if a clerk is able to reproduce the serial number of the ticket, with or without a reprint, the clerk may cancel the ticket.

Many options have been proposed to eliminate the potential for fraud. One option is to eliminate the on-site cancellation of lottery tickets. This option has been found to be inefficient given the large number of mistakes in lottery tickets created by the shear volume of tickets sold. Another option has been to eliminate the serial numbers on the lottery tickets and use only the computer scanned barcodes in the cancellation process. However, many tickets are unable to be scanned by the lottery terminal for many reasons, such as if the print on the ticket is too light, or a stray mark confuses the scanner.

The present invention contemplates marking the ticket, either manually or mechanically, as void before it may be canceled by the machine. Ticket reprints would be eliminated, and the terminal would have to read a portion of the barcode and the void mark to cancel a ticket. A complete serial number could be typed in if the barcode is not able to be read by the terminal. The requirement that the actual ticket being canceled be read by the scanner in the terminal would eliminate the fraud associated with the cancellation of lottery tickets.

The present invention contemplates a new and improved method for canceling lottery tickets which is simple in design, effective in use, and overcomes the foregoing difficulties and others while providing better and more advantageous overall results.

SUMMARY OF THE INVENTION

In accordance with the present invention, a new and improved method for canceling lottery tickets is provided which prevents fraud, is simple for lottery agents, and requires little or no explanation to the public.

More particularly, in accordance with the present invention, the method for canceling a lottery ticket comprises the steps of: altering the lottery ticket to mark the lottery ticket as void; reading the lottery ticket marked void by a terminal; and, canceling the lottery ticket by the terminal.

According to one aspect of the invention, the method for canceling lottery tickets comprises the step of marking the lottery ticket void by punching a hole in the lottery ticket.

According to another aspect of the invention, the method for canceling lottery tickets comprises the step of marking the lottery ticket void by making a mark on the lottery ticket.

According to another aspect of the invention, the method for canceling lottery tickets comprises the steps of: adding a printer to the terminal; printing a mark on the lottery ticket to mark the lottery ticket void; and, moving the lottery ticket to the terminal.

One advantage of the present invention is the ability to modify the cancellation method of lottery tickets without having to change hardware.

Another advantage of the present invention is to require the presence of the original ticket marked as void in order to cancel the ticket, eliminating fraud.

Another advantage of the present invention is to have canceled lottery tickets clearly marked as canceled and void.

Still other benefits and advantages of the invention will become apparent to those skilled in the art to which it pertains upon a reading and understanding of the following detailed specification.

BRIEF DESCRIPTION OF THE DRAWINGS

The invention may take physical form in certain parts and arrangements of parts, a preferred embodiment of which will be described in detail in this specification and illustrated in the accompanying drawings which form a part hereof and wherein.

DESCRIPTION OF THE PREFERRED EMBODIMENT

Figure 1:
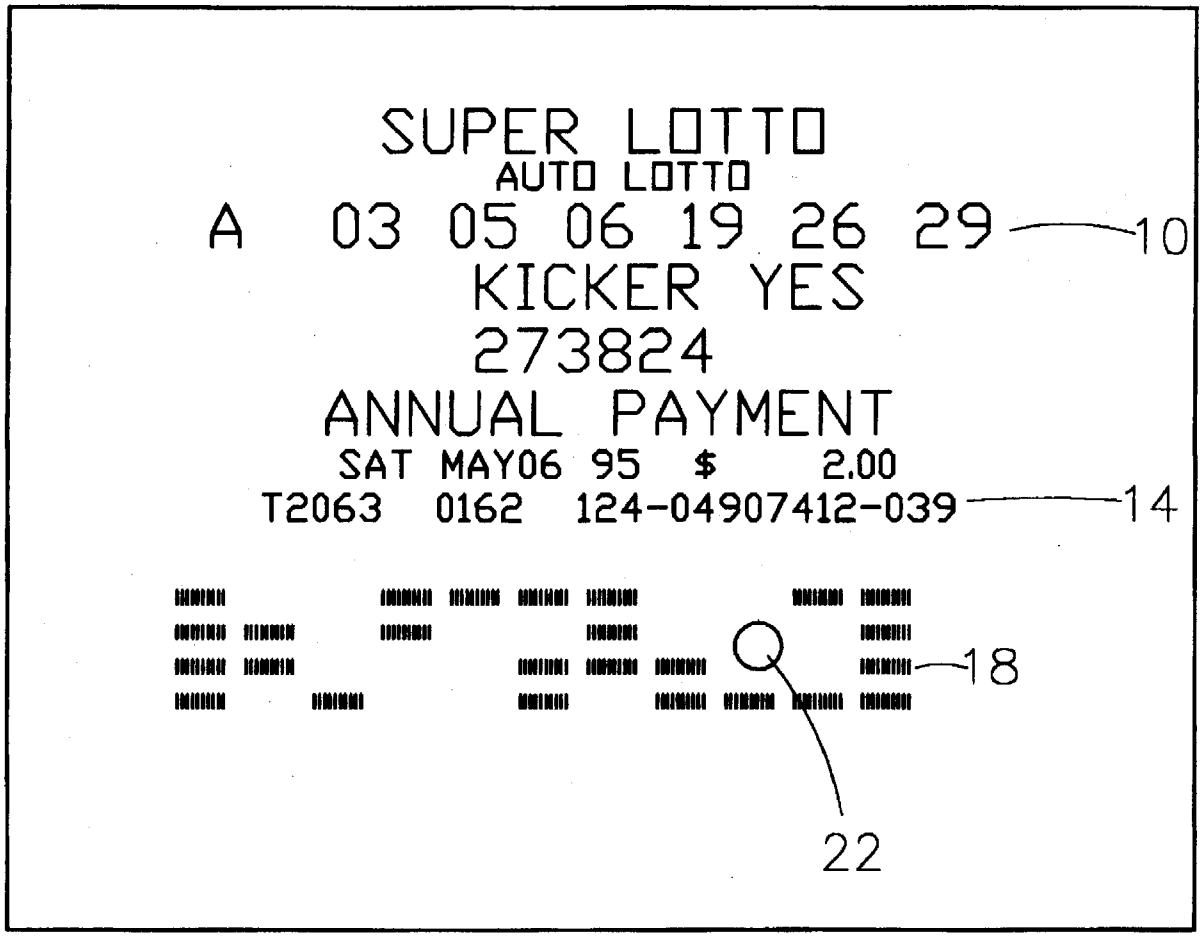
FIG. 1 shows a lottery ticket with one embodiment of the present invention.

Referring now to the drawings wherein the showings are for purposes of illustrating a preferred embodiment of the invention only and not for purposes of limiting same, FIG. 1 shows a detailed view of a lottery ticket. The numbers 10 are selected either by a customer on a bet slip (not shown) or by random by the lottery computer. The ticket also contains a serial number 14 that is unique to the ticket. The ticket is identifiable through the unique serial number 14 by the lottery terminal. The barcode 18 on the ticket places the unique serial number 14 into a code that is quickly readable by a scanner in the lottery terminal. The scanner in the terminal can identify marks placed on the ticket in specified places. A hole 22 punched into the ticket using a commercially available hole punch may be read by the scanner that reads the barcode 18. The ticket cancellation works by requiring that the scanner read the hole 22 in the ticket and at least part of the barcode 18 before the scanner will allow the serial number 14 to be entered into the terminal for cancellation. The requirement that the actual ticket be present and marked will eliminate the fraud associated with canceling lottery tickets purchased by customers that have left the lottery outlet. The only education of customers would come in the form of informing the public not to buy any lottery ticket with a hole 22 in it.

Figure 2:
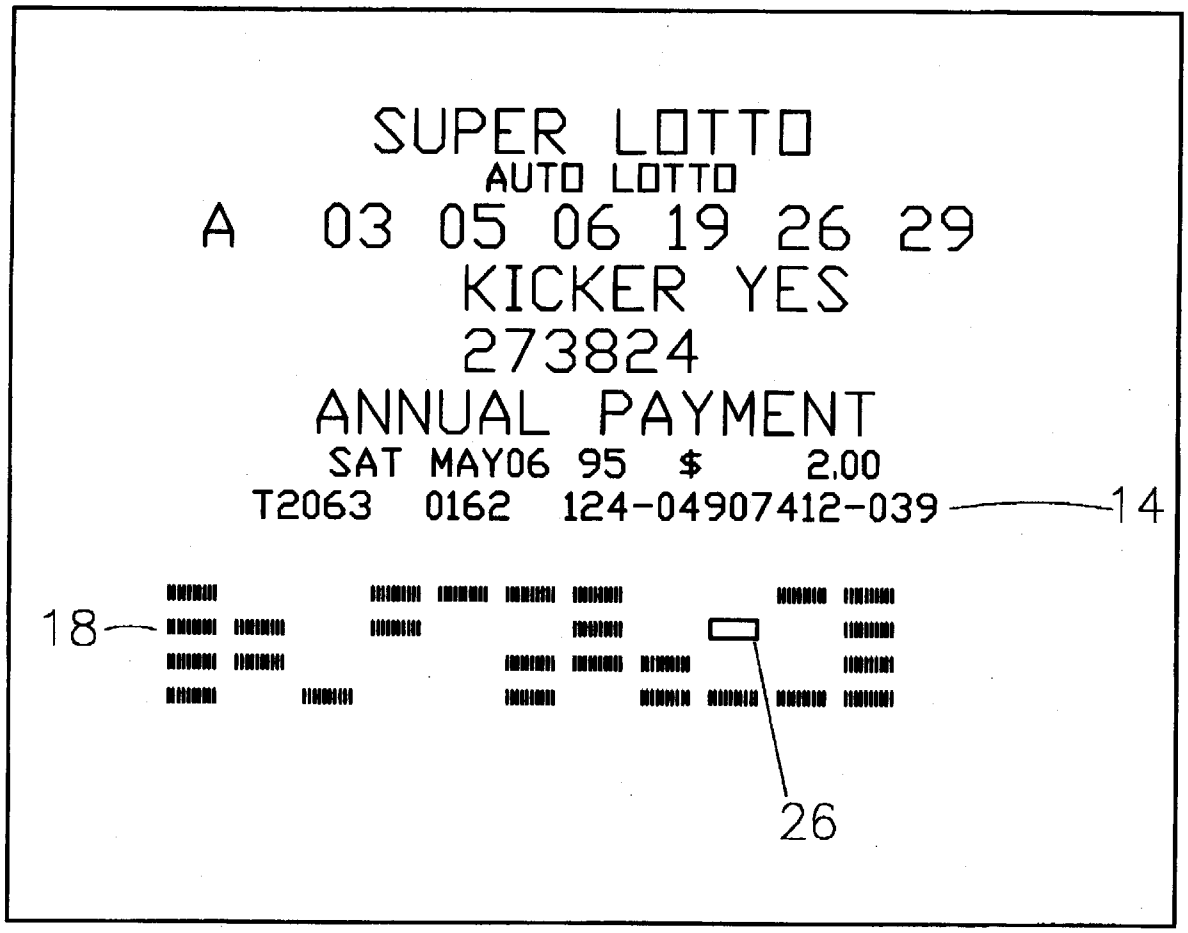
FIG. 2 shows another embodiment of the present invention.

FIG. 2 shows an additional embodiment of the present invention. A void box 26 is provided on the ticket that must be filled in before the ticket may be canceled. The void box 26, when filled in would tell the scanner and terminal that the ticket is to be canceled. The barcode 18 would then be scanned by the scanner and ticket canceled. If the scanner cannot read the entire barcode 18, the serial number 14 may then be entered to complete cancellation of the lottery ticket. Once again, consumers would have to be educated not to buy a ticket if the void box 26 is filled in.

Figure 3:
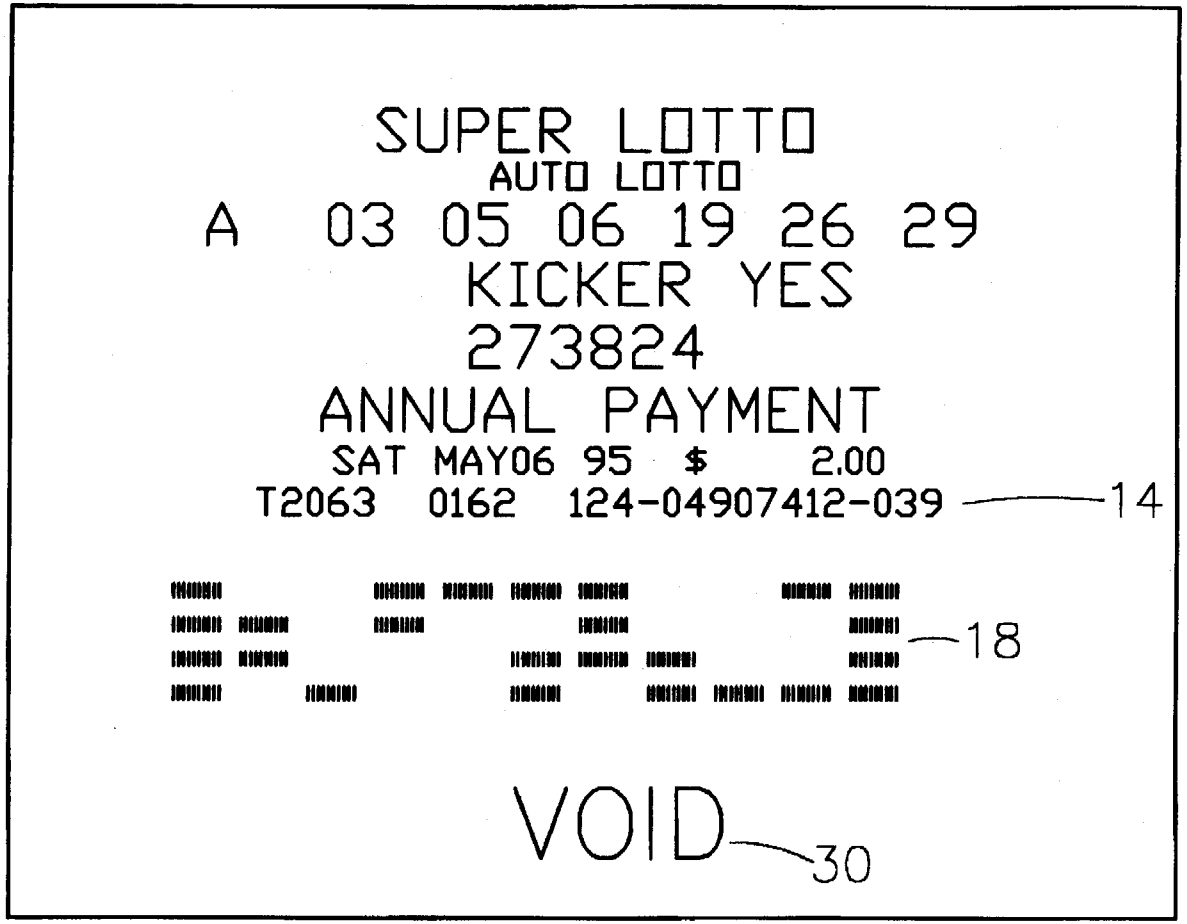
FIG. 3 shows another embodiment of the present invention.

FIG. 3 shows an additional embodiment of the present invention. An auxiliary device such as a printer may be added to place a void mark 30 on a place on the ticket where the scanner may read it. The void mark 30 may be the word "VOID," as in the figure, or any other mark that conveys the same message. The scanner would have to read a void mark 30 on the ticket along with a portion of the barcode 18 before allowing cancellation either by completely reading the barcode or by accepting the manually entered serial number 14.

The invention has been described with reference to a preferred embodiment. Obviously, modifications and alterations will occur to others upon a reading and understanding of this specification. It is intended to include all such modifications and alterations insofar as they come within the scope of the appended claims or equivalents thereof.

Having thus described the invention, it is now claimed:

1. A method for voiding a valid lottery ticket having a record of a serial control number comprising the steps of:

altering the lottery ticket to mark the lottery ticket as void; reading the lottery ticket marked void by a terminal; and canceling said serial control number record of the lottery ticket in response to the terminal reading the void mark.

2. The method for canceling lottery tickets of claim 1 further comprising the step of marking the lottery ticket void by punching a hole in the lottery ticket.

3. The method for canceling lottery tickets of claim 1 further comprising the step of marking the lottery ticket void by making a mark on the lottery ticket.

4. The method for canceling lottery tickets of claim 1 further comprising the steps of:

adding a printer to the terminal;

printing a mark on the lottery ticket to mark the lottery ticket void; and, moving the lottery ticket to the terminal.

* * * * *